US005743249A

United States Patent [19]

Boekeloo et al.

[11] Patent Number: 5,743,249

[45] Date of Patent: Apr. 28, 1998

[54] GAS FIREPLACE SYSTEM BURNER ASSEMBLY

[75] Inventors: Maurice O. Boekeloo, San Dimas; Terrell A. Stone, Glendora; A. Robert St. Julien, Artesia, all of Calif.

[73] Assignee: Robert H. Peterson Co., City of Industry, Calif.

[21] Appl. No.: 585,179

[22] Filed: Jan. 11, 1996

[51] Int. Cl.[6] ..... F24C 3/00

[52] U.S. Cl. ..... 126/512; 126/92 R; 431/125

[58] Field of Search ..... 126/512, 92 R, 126/92 AC, 91 R, 85 R; 431/125, 126, 350

[56] References Cited

U.S. PATENT DOCUMENTS

| | | | |
|---|---|---|---|
| 2,007,292 | 7/1935 | Carleton | 126/512 |
| 3,291,116 | 12/1966 | Brooks | 431/125 |
| 3,583,845 | 6/1971 | Pulone | 126/512 |
| 4,886,445 | 12/1989 | Richardson | 126/512 |
| 5,000,162 | 3/1991 | Shimek et al. | 461/125 |
| 5,081,981 | 1/1992 | Beal | 431/125 |
| 5,263,852 | 11/1993 | Beck | 126/512 |
| 5,320,520 | 6/1994 | Barth et al. | 431/125 |

*Primary Examiner*—James C. Yeung

*Attorney, Agent, or Firm*—Wood, Phillips, VanSanten, Clark & Mortimer

[57] ABSTRACT

An improved burner assembly is disclosed for a gas fireplace system including a set of gas logs supported on a grate. The burner assembly includes a generally horizontal burner pan positionable beneath the grate. A burner is affixed to and extends upwardly from the burner pan. The burner comprises a generally rectangular elongate tube having a height substantially greater than a depth, to define an interior gas chamber, an inlet to the chamber for connection to a gas supply, and an outlet from the chamber, the outlet comprising an elongate narrow slot at the bottom of the burner proximate the burner pan.

22 Claims, 8 Drawing Sheets

GAS INLET
164
162
160
166
168

160
52
38
164
162
166
168
170
90
37
34
54

GAS FIREPLACE SYSTEM BURNER ASSEMBLY

FIELD OF INVENTION

The present invention relates to a gas fireplace system including a set of gas logs supported on a grate and, more particularly, to an improved burner assembly therefor.

BACKGROUND OF THE INVENTION

For various reasons there has been a trend to shift away from wood burning fireplaces to gas burning fireplaces. With a gas burning fireplace, one seeks to present an appearance similar to a wood burning fireplace. This is accomplished with a gas burner system and log holder to support and position a set of gas logs. The set of gas logs are of a ceramic or other material which are non-flammable but configured to resemble actual firewood.

In a typical gas fireplace system, the burner system includes a burner pan on which is supported a burner. The burner is typically an elongate tube having a plurality of port holes. Gas enters under pressure, from a gas supply, at one end of the burner and is forced out the port holes. Thus, the gas is forced into the area of the burner pan. The burner pan is covered with, for example, sand, vermiculite granules, pumice or lava granules or other material to distribute the flame from the burner. Atop this is another material, such as rock wool, to resemble glowing embers.

While the typical gas fireplace system is satisfactory for most applications, some installations provide difficulties. For example, additional safety components or controls used in many installations take up substantial space. This limits the size of the log sets which can be used while maintaining desired centering of the log sets for aesthetics. Also, the typical burner might require significant amounts of gas to provide ample flame height to adequately resemble the woodburning fireplace. Thus, undue use of energy can be an issue. As with many other situations there is a desire to fully replicate the woodburning fireplace at minimal cost and energy usage.

The present invention is directed to solving one or more of the above problems in a novel and simple manner.

SUMMARY OF THE INVENTION

In accordance with the invention there is disclosed an improved burner assembly which distributes gas in a chamber to create a higher flame.

Broadly, there is disclosed herein an improved burner assembly for a gas fireplace system including a set of gas logs supported above a generally horizontal surface. The burner assembly includes a generally horizontal burner pan positionable beneath the gas log set. A burner is affixed to and extends upwardly from the burner pan. The burner comprises a generally rectangular elongate tube having a height substantially greater than a depth, to define an interior gas chamber, an inlet to the chamber for connection to a gas supply, and an outlet from the chamber, the outlet comprising an elongate narrow slot at the bottom of the burner proximate the burner pan.

In accordance with the invention the burner is integral with the burner pan. The burner pan assembly comprises a generally flat plate turned upwardly along a central line to define a horizontal pan forwardly of the line and a vertical portion, the vertical portion being forwardly reverse bent to define the interior chamber and having a distal edge proximate the horizontal pan to define the narrow slot. The inlet comprises an opening in a rear wall of the vertical portion. The vertical portion includes a front wall in parallel relation with the rear wall. The front wall is spaced from the rear wall approximately ⅛". The slot is approximately ⅛" wide.

In accordance with another aspect of the invention there is provided opposite side walls turned upwardly from the horizontal pan and extending from the vertical portion to a front marginal edge of the horizontal pan.

In accordance with another aspect of the invention there is disclosed an improved burner system including a generally horizontal burner pan positionable beneath the gas log set. A burner is affixed to the burner pan. The burner comprises an elongate tube, to define an interior gas chamber, an inlet into the chamber for connection to a gas supply, the inlet being at a generally central longitudinal position of the tube and an outlet proximate a bottom of the burner.

In accordance with a further aspect of the invention there is disclosed a burner assembly including a generally horizontal burner pan positionable beneath the gas log set. A burner is affixed to and extends upwardly from the burner pan. The burner comprises a generally rectangular elongate tube to define an interior gas chamber having a relatively narrow depth, an inlet into the chamber for connection to a gas supply, and a narrow outlet from the chamber. Gas entering the chamber is distributed within the chamber as a result of the narrow depth of the chamber so that gas is forced out the narrow outlet to produce a high flame.

There is disclosed in accordance with a yet further aspect of the invention a gas fireplace system including a log support and a set of gas logs on the log support. A generally horizontal burner pan is positioned beneath the gas log set. A burner is affixed to the burner pan. The burner comprises an elongate tube, to define an interior gas chamber, an inlet into the chamber, the inlet being at a generally central longitudinal position of the tube, and an outlet proximate a bottom of the burner. A burner control system is provided for connection between the inlet and the gas supply, the control system being positioned substantially rearwardly of the burner.

Further features and advantages of the invention will be readily apparent from the specification and from the drawing.

DETAILED DESCRIPTION OF THE INVENTION

Figure 1:
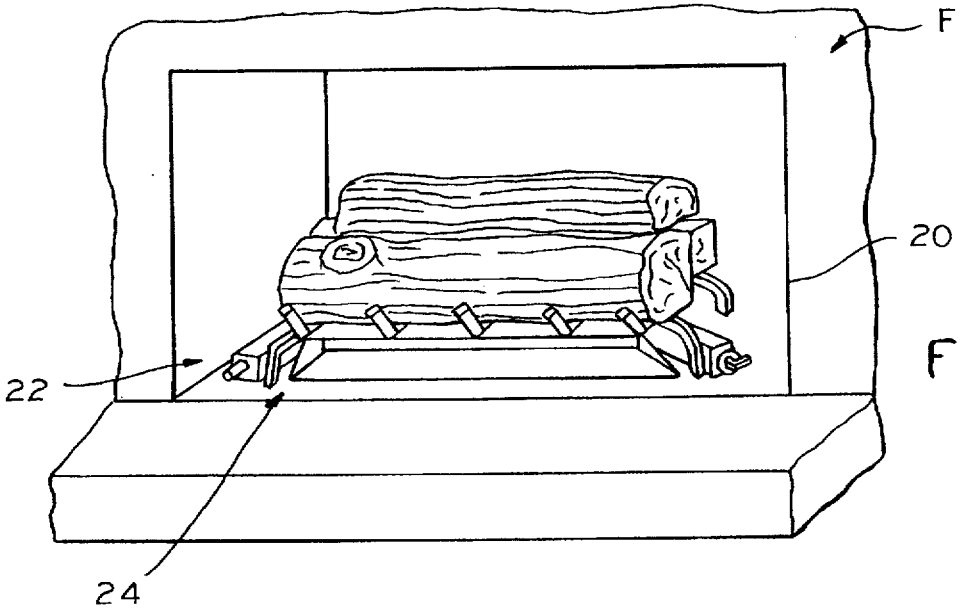
FIG. 1 illustrates a partial perspective view of a fireplace including a gas fireplace system according to the invention.

Referring initially to FIG. 1, there is illustrated a fireplace F in the form of a solid-fuel burning fireplace with a working flue constructed of non-combustible material. The fireplace F is designed to include an opening 20 into a fire chamber 22. Installed in the fire chamber 22 is a gas fireplace system 24 according to the invention. Particularly, the gas fireplace system 24 is designed to provide the natural beauty of a wood fire with the best economy and efficiency available in a gas log set.

Figure 2:
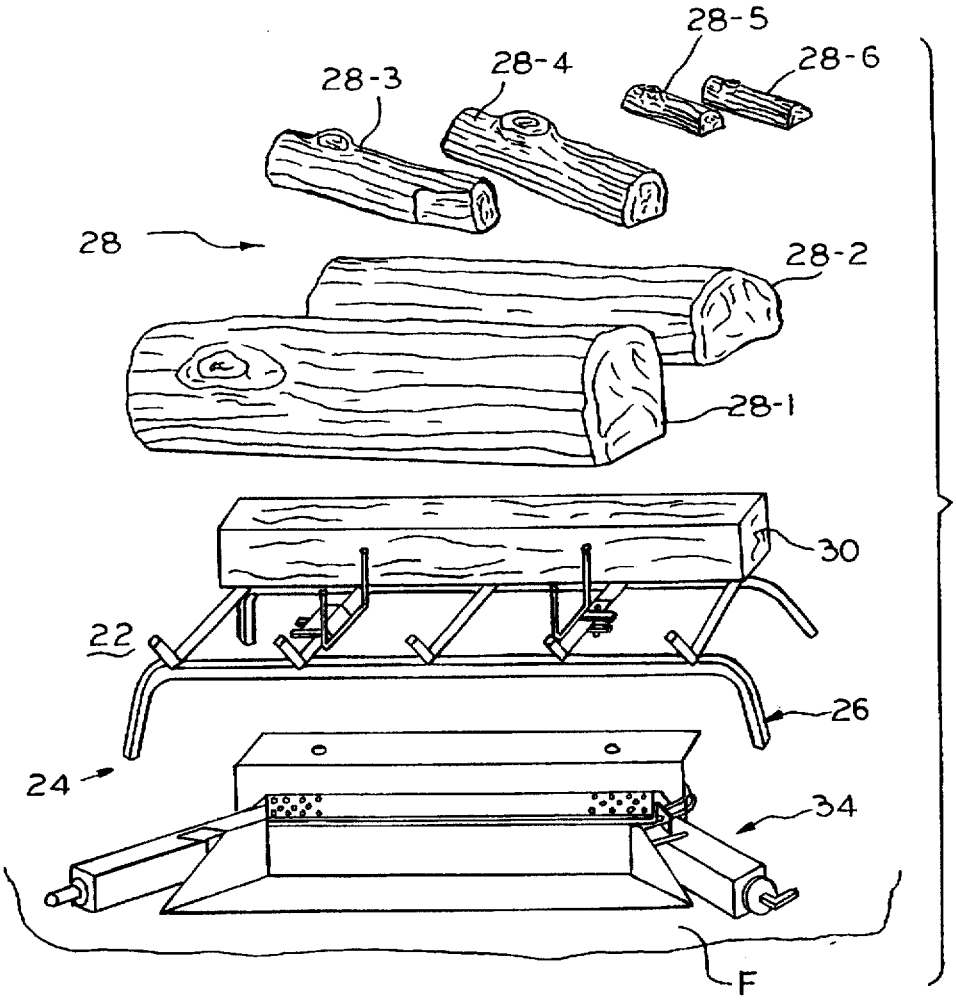
FIG. 2 is a partial exploded view of the gas fireplace system according to the invention.
Figure 3:
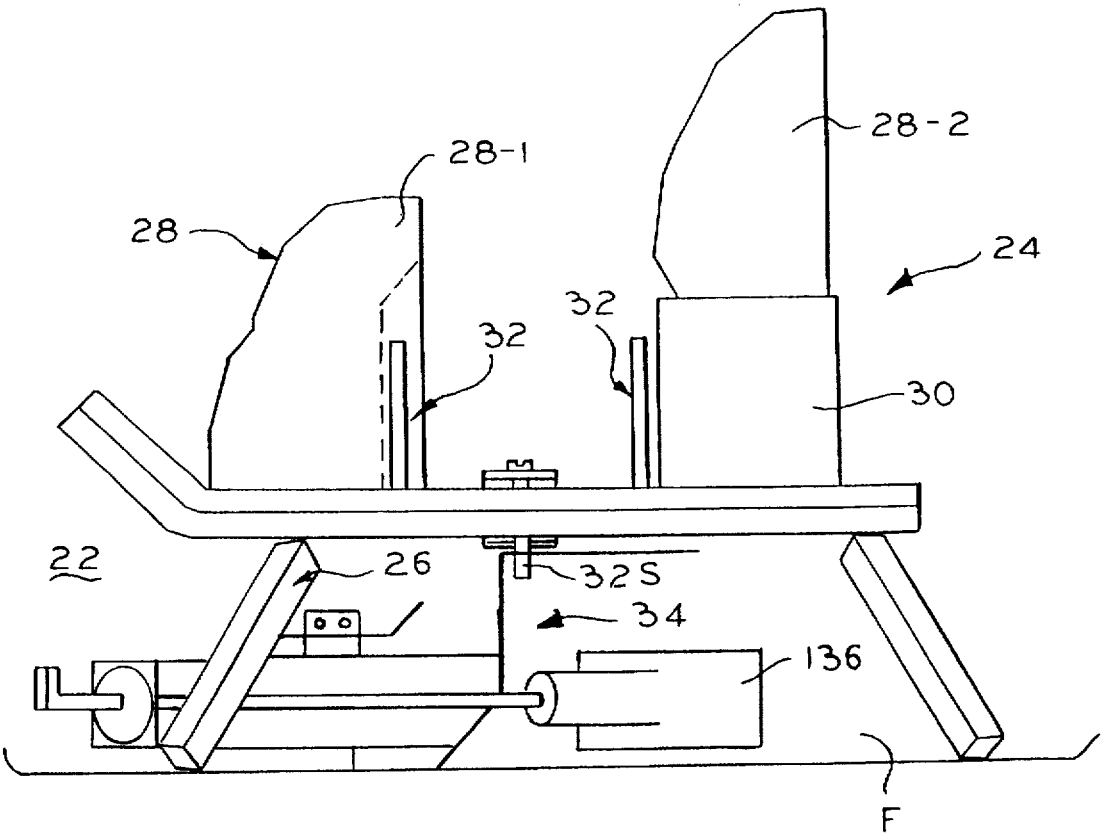
FIG. 3 is a side elevation view of the gas fireplace system according to the invention.
Figure 4:
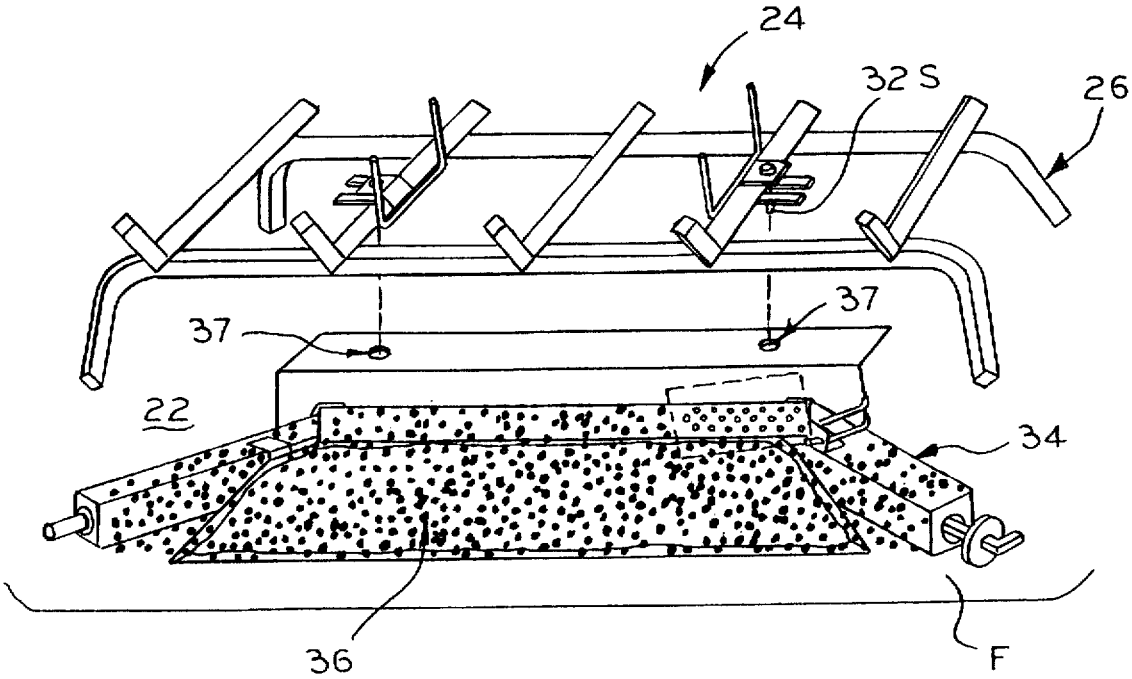
FIG. 4 is a perspective view of the gas fireplace system according to the invention with the gas logs removed for clarity.

Referring to FIGS. 2–4, the gas fireplace system 24 is illustrated in greater detail. While the system 24 is provided in various configurations, the embodiment of FIGS. 2–4 uses a pilot with an igniter. The invention herein can be used with any control configuration and is more particularly directed to the burner assembly, as will be apparent. Also, the gas fireplace system 24, and particularly the burner system, could be used in fireplaces specifically designed for gas fuel.

The chamber 22 is defined in part by the bottom wall or floor F providing a generally horizontal support surface. Supported on the floor F is a grate 26 of conventional construction for supporting a set of gas logs 28. Particularly, the gas log set 28 includes a front bottom log 28-1, a rear bottom log 28-2, middle logs 28-3 and 28-4 and top logs 28-5 and 28-6. A brick or log support 30 is positioned on the grate 26 for supporting the rear bottom log 28-2. Log locators 32 are used for maintaining desired positioning of the gas log set 28 on the grate.

A burner system 34 according to the invention is positioned on the floor F beneath the grate 26. As shown in FIG. 4, granules 36 are spread over the burner system 34. The granules 36 may comprise, for example, sand, vermiculite granules, pumice or lava granules or other material to distribute the flame from the burner system 34. Atop this is another material, such as rock wool, to resemble glowing embers. Screws 32S associated with the log locators 32 extend downwardly and are received in openings 37 in the burner system 34 to maintain desired position of the burner system 34 relative to the grate 26 and logs 28.

Figure 5B:
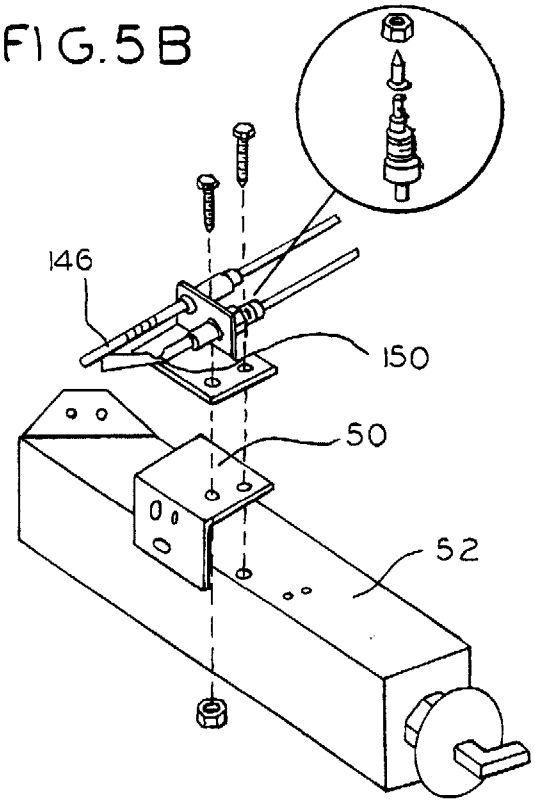
FIG. 5B comprises a partial perspective view of a pilot assembly of the burner system of FIG. 5.
Figure 5A:
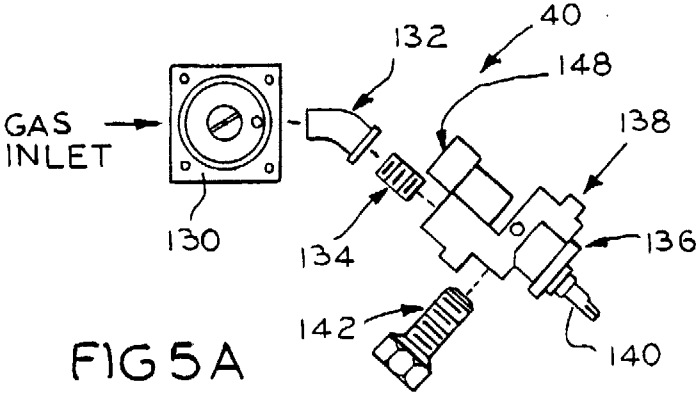
FIG. 5A comprises a detailed view of a safety control system of the burner system of FIG. 5.
Figure 5:
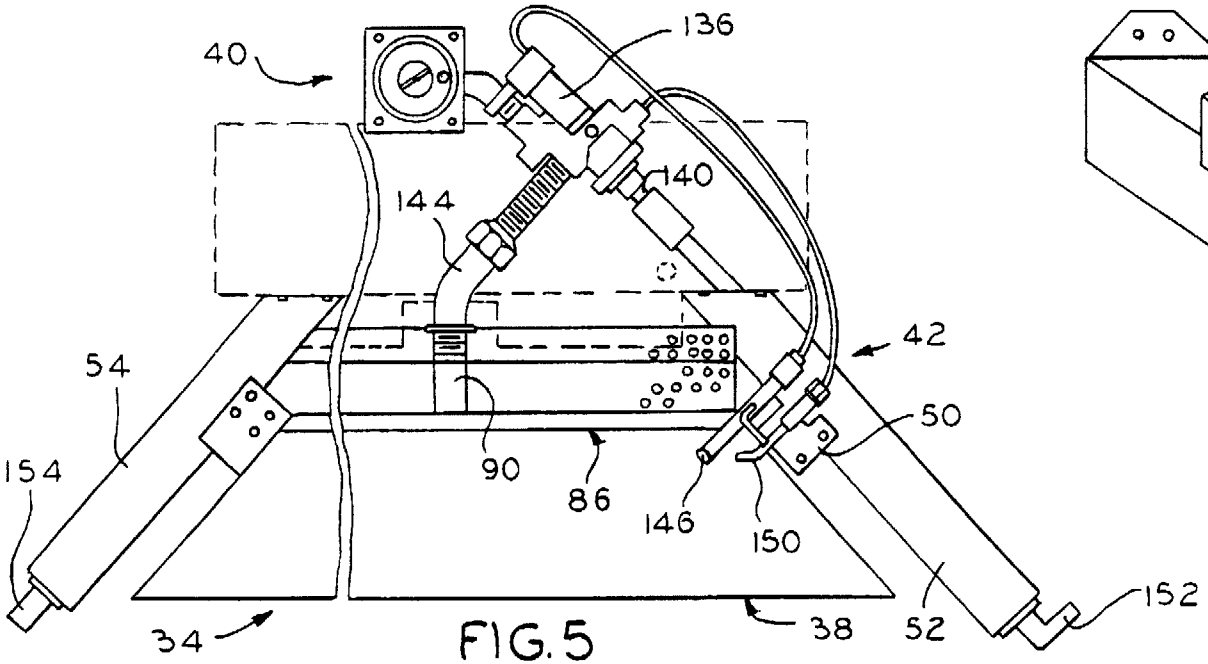
FIG. 5 is a plan view of a burner system according to the invention.

Referring to FIGS. 5, 5A and 5B, the burner system 34 is illustrated in greater detail. The burner system 34 includes a burner assembly 38 to which are installed a safety control system 40 and a pilot assembly 42. The burner system 34 is shown broken away. This is to indicate the fact that the longitudinal dimension of the burner system 34 can change according to the size of the fireplace in which it will be installed.

Referring to FIGS. 7, 8, 9 and 10, the burner assembly 38 is illustrated in greater detail, with control components omitted. Particularly, the burner assembly 38 includes a burner pan 44, with an integral burner 75, a perforated shield 46, a heat shield 48, a pilot bracket 50, a handle shield 52, an igniter bracket 53 and an igniter shield 54.

Figure 11:
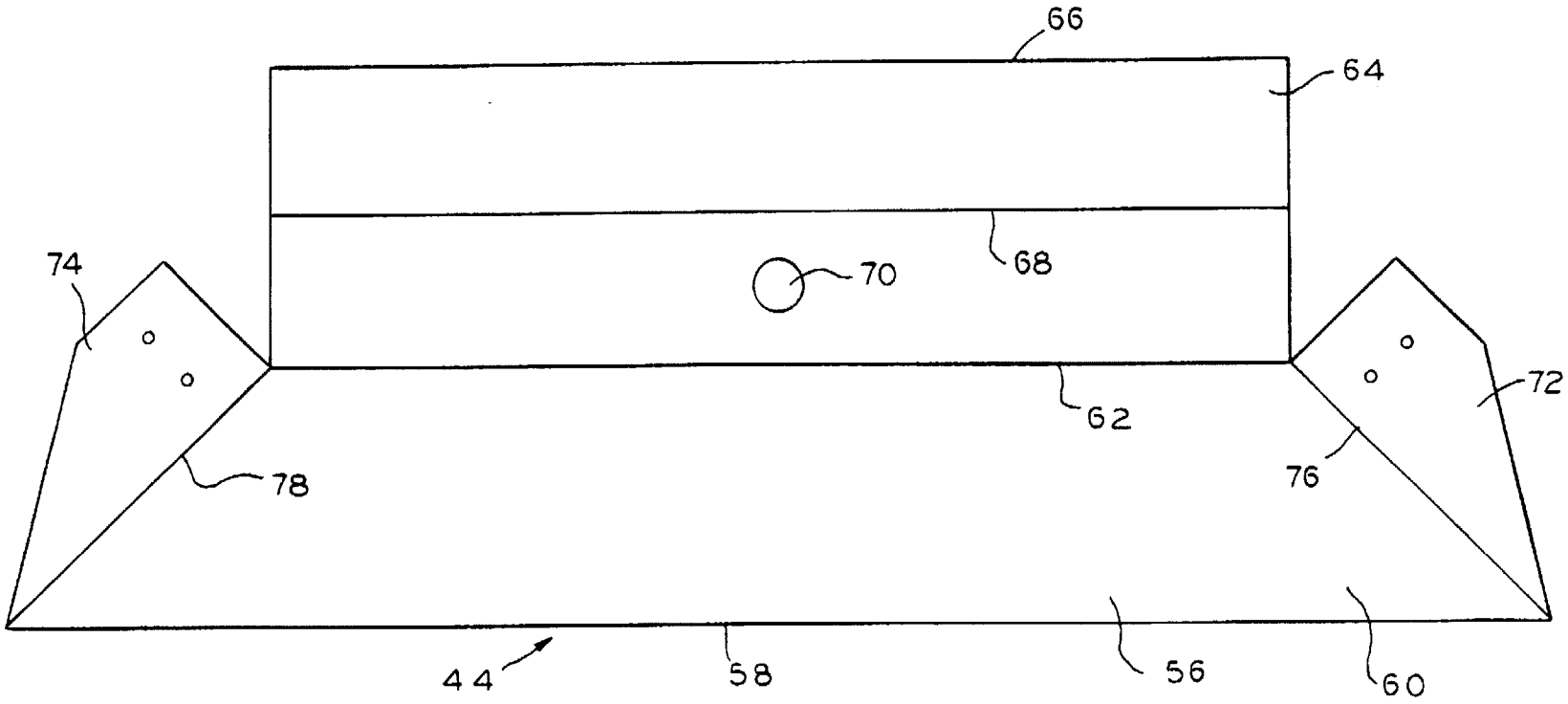
FIG. 11 is a plan view of a flat plate in an unformed state used to form the burner pan with integral burner of the burner assembly of FIG. 7.

Referring to FIG. 11, the burner pan 44 is illustrated in an unformed state in the form of a generally flat plate 56. In the illustrated embodiment of the invention the plate 56 is 18 gauge cold rolled steel with a flat black powder coat finish. The plate 56 has a longitudinal front edge 58. The front edge 58 defines the front of a trapezoidal burner pan section 60. A generally central fold line 62 defines a rear edge of the burner pan section 60 and connects the burner pan section 60 to a rectangular section 64 defining a distal marginal edge 66. A further fold line 68 is provided half way between the fold line 62 and the marginal edge 66. A circular opening 70 is generally centrally located in the rectangular portion between the fold lines 62 and 68. Opposite trapezoidal side pieces 72 and 74 are connected at opposite fold edges 76 and 78, respectively, of the pan section 60.

In the illustrated embodiment of the invention, the distance between the front edge 58 and the central fold line 62 is three inches, while the distance between the fold line 68 and each of the fold line 62 and distal edge 66 is one and three quarter inches. Advantageously, the opening 70 is centered in the indicated rectangular portion. However, with smaller size burner assemblies, the opening might be slightly off centered due to space requirements.

Figure 12:
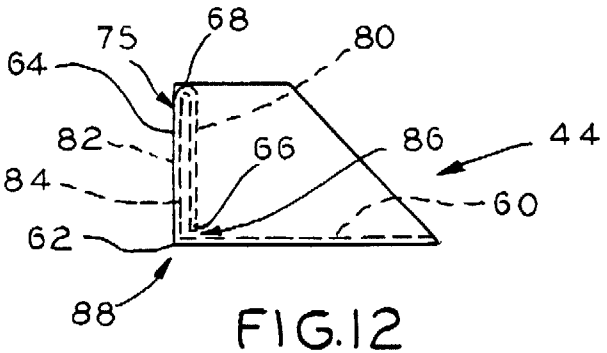
FIG. 12 is a side elevation view of the formed burner pan from the plate of FIG. 11.

The plate 56 is formed as illustrated in FIG. 12 to provide an integral pan, defined by the pan section 60, and burner 75. The burner 75 is thus affixed to and extends upwardly from the burner pan section 60. Particularly, the rectangular portion 64 is turned upwardly along the central fold line 62 to define a vertical rectangular section. The vertical rectangular section 64 is forwardly reverse bent at the fold line 68. Thus, the vertical section 64 includes a front wall 80 and a parallel rear wall 82 defining a rectangular, narrow interior chamber 84 forming the burner 75. A narrow slot 86 is provided between the distal edge 66 and the burner pan section 60 defining a narrow outlet from the interior chamber 84 extending across the bottom rear edge of the burner pan section 60. In accordance with the invention, there is an approximately ⅛" gap, illustrated at 88, defining the depth of the interior chamber 84. The height of the interior chamber is approximately 1¾", representing the distance between the fold lines 62 and 68 and the fold line 68 and the distal edge 66. The reverse fold at 68 has an approximately 1/16" radius. The slot 86 is approximately 3/32" wide. As indicated at 88, the edge 66 can be welded to the pan section 60 to maintain desired slot spacing, and the ends of the burner assembly welded to seal the ends of the burner 75. Finally, the side walls 72 and 74 are folded upwardly 90° to provide side walls to the burner pan section 60. The opening 70 in the rear wall 82 defines an inlet into the interior chamber 84, as is apparent.

The burner 75 comprises an elongate rectangular tube having a height substantially greater than its depth. With the long narrow outlet slot 86 the burner 75 provides a sheet flame. For these reasons, the burner 75 is referred to herein as a ribbon burner. Gas entering the chamber 84 is distributed within the chamber as a result of the narrow depth so that gas is forced out the narrow outlet 86 to produce a high flame.

While the burner 75 is shown herein as in integral part of the pan 44, the burner could be separately formed and appropriately affixed to the pan by other known means.

Referring again to FIGS. 7 and 10, a gas nipple 90 is suitably fastened to the burner rear wall 82 at the opening 70 to facilitate connection to a gas supply.

Figure 15:
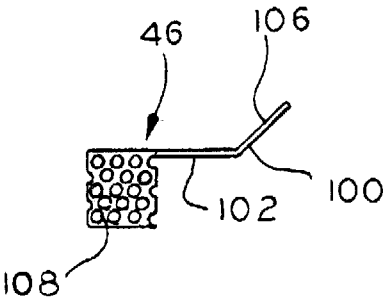
FIG. 15 is a side elevation view of the shield of FIG. 13.
Figure 14:
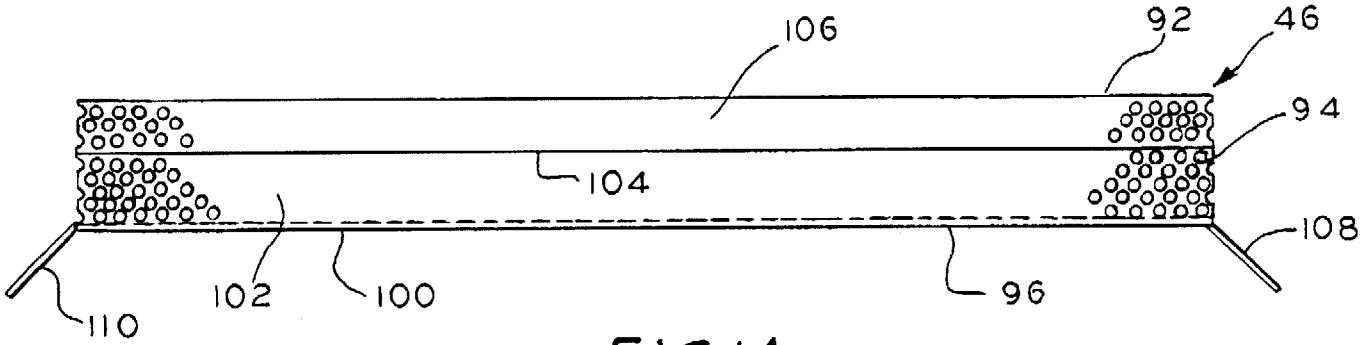
FIG. 14 is a top plan view of the shield of FIG. 13.
Figure 13:
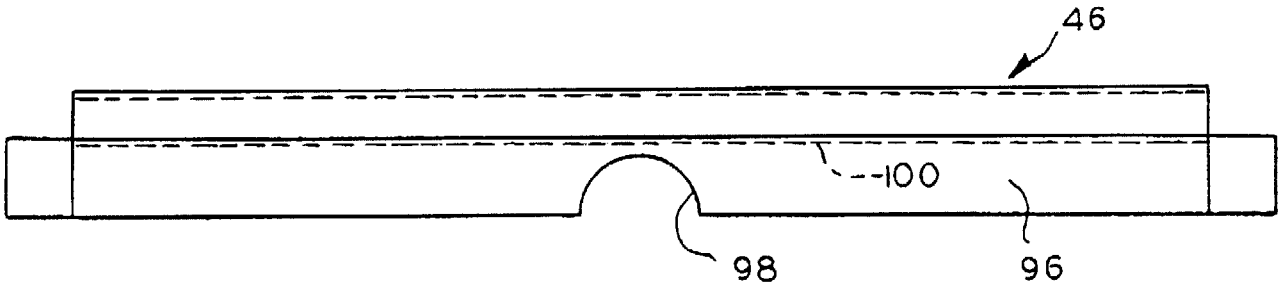
FIG. 13 is a front elevation view of a shield of the burner assembly of FIG. 7.

Referring to FIGS. 13, 14 and 15, the perforated shield 46 is illustrated. The perforated shield 46 comprises a formed plate 92 perforated with openings 94, only some of which are illustrated for clarity. The shield 46 includes a front wall 96 having a generally central notch 98 and turned at 100 to a horizontal wall 102 and turned at a line 104 to a diagonal rear wall 106. The front wall 96 has opposite wings 108 and 110 extending beyond the horizontal wall 102 and bent at a 45° angle. The wings 108 and 110 are used for fastening the shield 46 to the burner pan sidewalls 72 and 74 using fasteners, such as fastener 108 of FIG. 7. The notch 98 is used for receiving the nipple 90.

Figure 16:
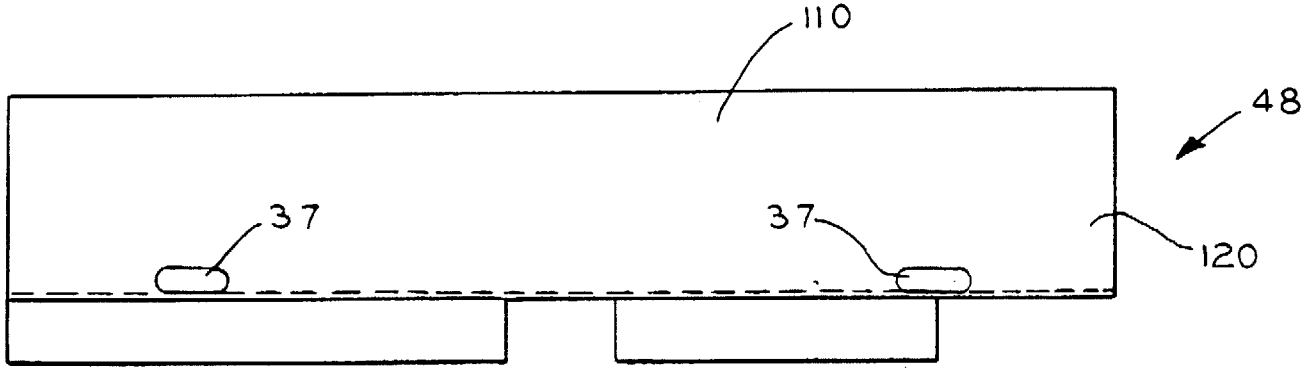
FIG. 16 is a top plan view of a heat shield of the burner assembly of FIG. 7.
Figure 17:
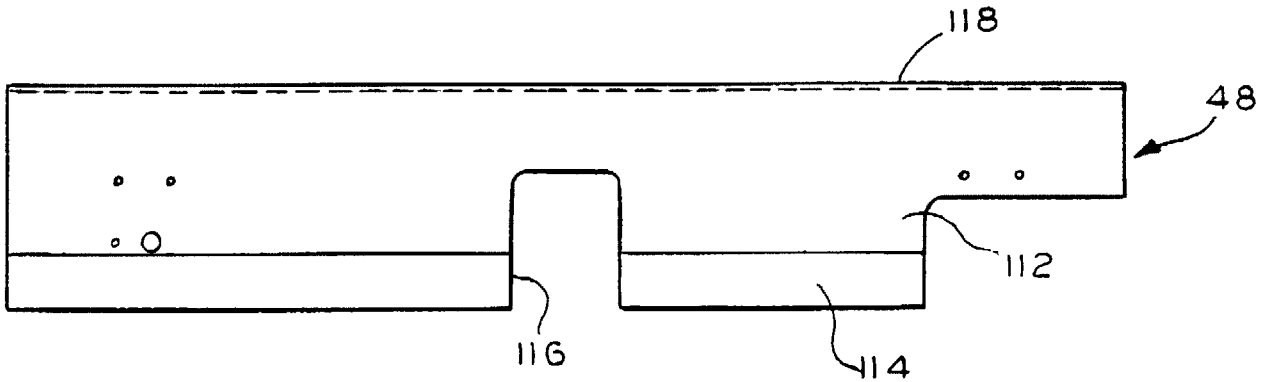
FIG. 17 is a front elevation view of the heat shield of FIG. 16.
Figure 18:
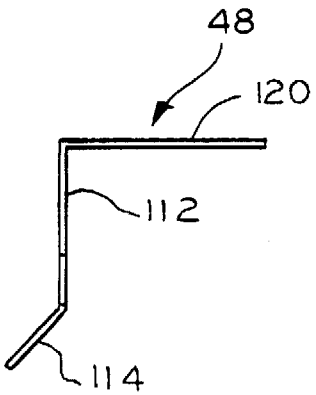
FIG. 18 is a side elevation view of the heat shield of FIG. 16.

Referring to FIG. 16, FIG. 17 and FIG. 18, the heat shield 48 is illustrated. The heat shield 48 comprises a formed plate 110 comprising a generally rectangular front wall 112 turned forwardly to define a front flange 114. A notch 116 is provided through the flange 114 and a portion of the front wall 112 to provide a space for the nipple 90. The plate 110 is turned at 118 to connect the front wall 112 to a top wall 120. The top wall 120 includes the alignment openings 37, discussed above.

The heat shield 48 is fastened to the burner pan 44 using the pilot bracket 50 and handle shield 52 and the igniter bracket 53 and igniter shield 54. Particularly, the brackets 50 and 53 are secured to the side walls 72 and 74, respectively, as is the perforated shield 46, via fasteners (not shown). The bracket 50 is in turn secured to the L-shaped handle shield 52. A rear end of the handle shield 52 is secured using fasteners 124 to the heat shield 48. The bracket 53 is in turn secured to the L-shaped igniter shield 54. A rear end of the igniter shield 54 is secured using fasteners 124 to the heat shield 48.

Figure 7:
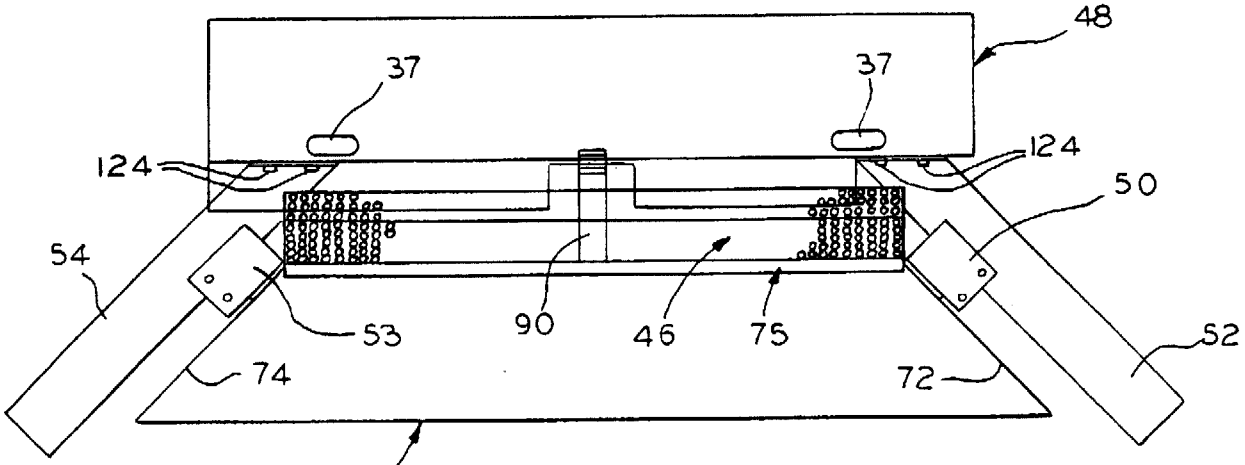
FIG. 7 is a plan view of a burner assembly of the burner systems of FIGS. 5 and 6.
Figure 8:
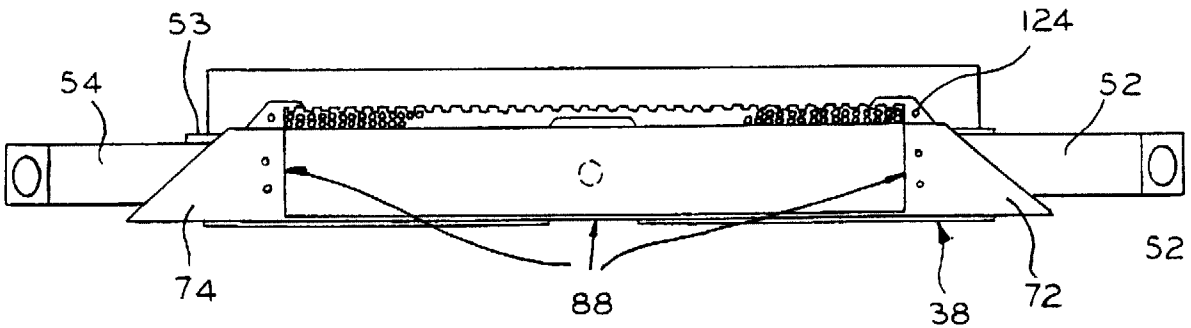
FIG. 8 is a front elevation view of the burner assembly of FIG. 7.
Figure 9:
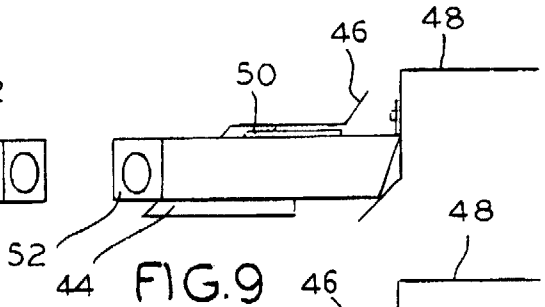
FIG. 9 is a side elevation view of the burner assembly of FIG. 7.
Figure 10:
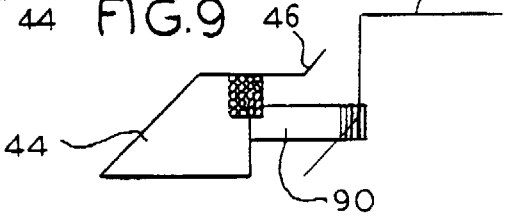
FIG. 10 is a side elevation view similar to FIG. 9 with parts removed for clarity.

Referring again to FIGS. 5, 5A and 5B, the burner system 34 uses the burner assembly 38 of FIG. 7 with a handle assembly 152 secured to the handle shield 52 for a pilot valve and an igniter assembly 154 secured to the igniter shield 54. The safety control system 40 includes a pressure regulator 130 including a gas inlet, as indicated. The gas inlet is connected using a conventional connector kit (not shown), to a gas supply. The outlet of the gas regulator 130 is connected via an elbow 132 and nipple 134 to a safety control valve 136. In some applications, the regulator is included in the control valve. The safety control valve 136 includes a pilot outlet 138, a control shutoff 140, and either a natural gas fuel injector or propane gas air mixer 142 for connection via an elbow 144 to the burner assembly nipple 90.

The pilot assembly 42 includes a thermocouple 146 connected to a thermocouple inlet 148 of the safety valve 136 and a pilot outlet 150 connected to the safety valve pilot outlet 138, as indicated. The thermocouple 146 and pilot outlet 150 are connected to the pilot bracket 50 in a conventional manner. The handle assembly 152 is operatively connected to the safety control valve shutoff 40, as shown in FIG. 5.

The igniter assembly 154 is connected to an opposite side of the burner assembly 38. The igniter assembly 154 is optional and if included would include a conventional piezo lighter (not shown) connected to an electrode proximate the pilot outlet 150 for lighting the same.

Figure 6A:
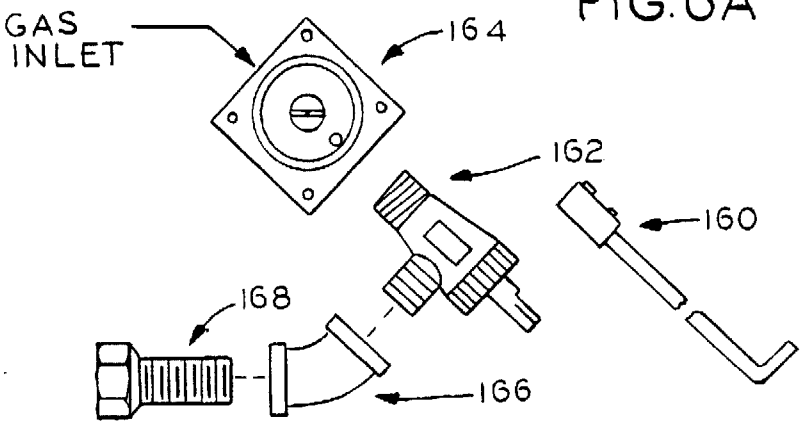
FIG. 6A is a detailed view of a gas inlet control of the burner system of FIG. 6.
Figure 6:
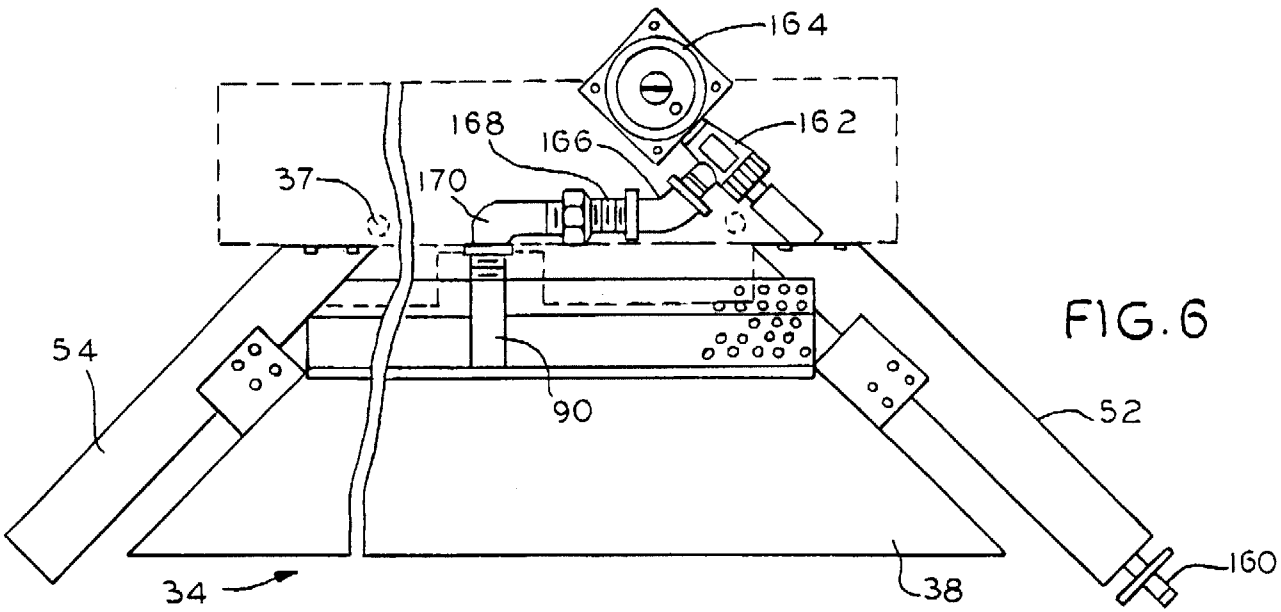
FIG. 6 is a view similar to that of FIG. 5 of a fireplace system with a manual start feature.

Referring to FIGS. 6 and 6A, the burner system 34 is illustrated in an alternative embodiment with a manual valve. The burner assembly 38 is as shown in FIG. 7. In this instance the handle shield 52 is as shown in FIG. 7 and is provided for shielding a handle assembly 160 for controlling an on/off valve 162 positioned rearwardly of the burner assembly 38. Particularly, a pressure regulator 164 includes a gas inlet. The outlet of the pressure regulator 164 is connected to the gas valve 162. The gas valve 162 is connected via an elbow 166 and fuel injector or air mixer 168 to a further elbow 170 connected to the nipple 90. These control components are particularly illustrated in FIG. 6A.

In accordance with the invention, the burner assembly 38 uses what is referred to herein as a "ribbon burner" 75. This delivers a full, natural flame while often using as little as, or sometimes less than, one half the gas required with conventional burners. Particularly, this is due to the fact that gas entering the chamber is distributed within the chamber as a result of the narrow depth of the chamber so that gas is forced out the narrow outlet to produce a high flame. The granules 36 will spread the flame to some degree, but the flame is principally a sheet of flame which passes upwardly between the logs to create clean combustion. Because of the center inlet and distribution of gas in the chamber, an evenly balanced flame pattern with superior flame height across the log set is created. Flame balance adjustment can be accomplished simply by shifting the granules in the burner pan. This configuration not only produces a higher flame, but does so with lower BTU requirements than traditional sets.

By having the gas inlet in the rear of the burner assembly 38, the controls are hidden behind the burner, providing a natural look for the gas log set. Moreover, by having the center rear entry for the gas inlet, the pilot and control components fit within the side-to-side space of the burner assembly 38. This results in a smaller depth requirement than with other burner systems which due to certification or code requirements, or local or gas company restrictions or other customer preferences use a pilot or on/off valve. This configuration provides a small footprint which is only eleven to twelve inches from front to back.

We claim:

1. In a gas fireplace system including a set of gas logs and means for supporting the gas logs above a generally horizontal surface, an improved burner assembly comprising:

a generally horizontal burner pan positionable beneath the gas log set; and a burner affixed to and extending upwardly from said burner pan, said burner comprising a generally rectangular elongate tube having a depth of approximately one-eighth inch and a height at least eight times greater than the depth, to define an interior gas chamber, an inlet into said chamber for connection to a gas supply and an outlet from said chamber, the outlet comprising an elongate narrow slot at a bottom of the burner proximate the burner pan to force gas out the narrow slot to produce a high sheet flame.

2. The burner assembly of claim 1 wherein said burner is integral with said burner pan.

3. In a gas fireplace system including a set gas logs and means for supporting the gas logs above a generally horizontal surface, an improved burner assembly comprising:

a generally horizontal burner pan positionable beneath the gas log set; and a burner affixed to and extending upwardly from said burner pan, said burner comprising a generally rectangular elongate tube having a height substantially greater than its depth, to define an interior gas chamber, an inlet into said chamber for connection to a gas supply and an outlet from said chamber, the outlet comprising an elongate narrow slot at a bottom of the burner proximate the burner pan, wherein said burner pan assembly comprises a generally flat plate turned upwardly along a generally central line to define a horizontal pan forwardly of the line and a vertical portion, the vertical portion being forwardly reverse bent to define the interior chamber and having a distal edge proximate the horizontal pan to define the narrow slot.

4. The burner assembly of claim 3 wherein said inlet comprises an opening in a rear wall of the vertical portion.

5. The burner assembly of claim 3 wherein said vertical portion includes a rear wall in parallel relation with a front wall.

6. The burner assembly of claim 5 wherein the front wall is spaced from the rear wall approximately ⅛".

7. The burner assembly of claim 5 wherein said inlet comprises an opening generally centrally located in the rear wall.

8. The burner assembly of claim 3 further comprising opposite side walls turned upwardly from said horizontal pan and extending from the vertical portion to a front marginal edge of the horizontal pan.

9. In a gas fireplace system including a set of gas logs and means for supporting the gas logs above a generally horizontal surface, an improved burner assembly comprising:

a generally horizontal burner pan positionable beneath the gas log set; and a burner integral with said burner pan, said burner comprising an elongate tube having a depth of approximately one-eighth inch, to define an interior gas chamber, an inlet into said chamber for connection to a gas supply, said inlet being at a generally central longitudinal position of the tube and an outlet proximate a bottom of the burner to force gas out the outlet to produce a high sheet flame.

10. In a gas fireplace system including a set of gas logs and means for supporting the gas logs above a generally horizontal surface, an improved burner assembly comprising:

a generally horizontal burner pan positionable beneath the gas log set; and a burner integral with said burner pan, said burner comprising an elongate tube, to define an interior gas chamber, an inlet into said chamber for connection to a gas supply, said inlet being at a generally central longitudinal position of the tube and an outlet proximate a bottom of the burner, wherein said burner pan assembly comprises a generally flat plate turned upwardly along a generally central line to define a horizontal pan forwardly of the line and a vertical portion, the vertical portion being forwardly reverse bent to define the interior chamber and having a distal edge proximate the horizontal pan to define the outlet.

11. The burner assembly of claim 10 wherein said inlet comprises an opening in a rear wall of the vertical portion.

12. In a gas fireplace system including a set of gas logs and means for supporting the gas logs above a generally horizontal surface, an improved burner assembly comprising:

a generally horizontal burner pan positionable beneath the gas log set; and a burner affixed to and extending upwardly from said burner pan, said burner comprising a generally rectangular elongate tube to define an interior gas chamber having a relatively narrow depth of approximately one-eighth inch, an inlet into said chamber for connection to a gas supply, and a narrow elongate outlet from said chamber, whereby gas entering the chamber is distributed within the chamber as a result of the narrow depth of the chamber so that gas is forced out the narrow outlet to produce a high flame.

13. The burner assembly of claim 12 wherein said burner is integral with said burner pan.

14. In a gas fireplace system including a set of gas logs and means for supporting the gas logs above a generally horizontal surface, an improved burner assembly comprising:

a generally horizontal burner pan positionable beneath the gas log set; and a burner affixed to and extending upwardly from said burner pan, said burner comprising a generally rectangular elongate tube to define an interior gas chamber having a relatively narrow depth, an inlet into said chamber for connection to a gas supply, and a narrow outlet from said chamber, whereby gas entering the chamber is distributed within the chamber as a result of the narrow depth of the chamber so that gas is forced out the narrow outlet to produce a high flame, wherein said burner pan assembly comprises a generally flat plate turned upwardly along a generally central line to define a horizontal pan forwardly of the line and a vertical portion, the vertical portion being forwardly reverse bent to define the interior chamber and having a distal edge proximate the horizontal pan to define the outlet.

15. The burner assembly of claim 14 wherein said inlet comprises an opening in a rear wall of the vertical portion.

16. The burner assembly of claim 14 wherein said vertical portion includes a rear wall in parallel relation with a front wall.

17. The burner assembly of claim 16 wherein the front wall is spaced from the rear wall approximately ⅛".

18. The burner assembly of claim 16 wherein said inlet comprises an opening generally centrally located in the rear wall.

19. A gas fireplace system comprising:

a log support;

a set of gas logs on the support;

a generally horizontal burner pan positioned beneath the gas log set;

a burner affixed to said burner pan, said burner comprising an elongate tube having a depth of approximately one-eighth inch, to define an interior gas chamber, an inlet into said chamber, said inlet being at a generally central longitudinal position of the tube and an outlet proximate a bottom of the burner to force gas out the outlet to produce a high sheet flame; and a burner control system for connection between the inlet and a gas supply, the control system being positioned substantially rearwardly of the burner.

20. A gas fireplace system comprising:

a log support;

a set of gas logs on the support;

a generally horizontal burner pan positioned beneath the gas log set;

a burner affixed to said burner pan, said burner comprising an elongate tube, to define an interior gas chamber, an inlet into said chamber, said inlet being at a generally central longitudinal position of the tube and an outlet proximate a bottom of the burner; and a burner control system for connection between the inlet and a gas supply, the control system being positioned substantially rearwardly of the burner, wherein said burner pan and burner are integral comprising a generally flat plate turned upwardly along a generally central line to define a horizontal pan forwardly of the line and a vertical portion, the vertical portion being forwardly reverse bent to define the interior chamber and having a distal edge proximate the horizontal pan to define a narrow slot forming the outlet.

21. The gas fireplace system of claim 20 wherein said vertical portion includes a rear wall in parallel relation with a front wall and said inlet comprises an opening centrally located in the rear wall.

22. The gas fireplace system of claim 21 wherein the front wall is spaced from the rear wall approximately ⅛".

* * * * *